US007374589B2

(12) United States Patent
Bernasconi et al.

(10) Patent No.: US 7,374,589 B2
(45) Date of Patent: May 20, 2008

(54) FUEL WITH LOW SULPHUR CONTENT FOR DIESEL ENGINES

(75) Inventors: Christian Bernasconi, Charly/Vernaison (FR); Laurent Germanaud, Heyrieux (FR); Jean-Michel Laupie, Communay (FR); Paul Maldonado, Saint Symphorien d'Ozon (FR)

(73) Assignee: Elf Antar France, Courbevoie (FR)

( * ) Notice: Subject to any disclaimer, the term of this patent is extended or adjusted under 35 U.S.C. 154(b) by 285 days.

(21) Appl. No.: 10/446,851

(22) Filed: May 29, 2003

(65) Prior Publication Data

US 2004/0049971 A1 Mar. 18, 2004

Related U.S. Application Data

(63) Continuation of application No. 09/147,604, filed as application No. PCT/FR97/01417 on Jul. 29, 1997, now Pat. No. 6,592,639.

(30) Foreign Application Priority Data

Jul. 31, 1996 (FR) ..... 96 09662

(51) Int. Cl.
*C10L 1/22* (2006.01)
*C10L 1/18* (2006.01)

(52) U.S. Cl. ..... 44/388; 44/385; 44/408

(58) Field of Classification Search ..... 44/388, 44/408, 385

See application file for complete search history.

(56) References Cited

U.S. PATENT DOCUMENTS

| | | | | |
|---|---|---|---|---|
| 2,658,823 | A | | 11/1953 | Andress et al. |
| 2,682,336 | A | | 6/1954 | Moberley et al. |
| 2,686,713 | A | * | 8/1954 | White et al. ..... 44/306 |
| 2,692,821 | A | | 10/1954 | Ambrose et al. |
| 2,854,324 | A | | 9/1958 | Shen et al. |
| 2,882,232 | A | | 4/1959 | Haines et al. |
| 2,907,646 | A | | 10/1959 | O'Kelly et al. |
| 2,995,428 | A | | 8/1961 | Godar et al. |
| 3,157,629 | A | | 11/1964 | Patrick et al. |
| 3,273,981 | A | | 9/1966 | Furey |
| 3,287,273 | A | | 11/1966 | Furey et al. |
| 3,336,123 | A | | 8/1967 | Hill et al. |
| 3,468,639 | A | | 9/1969 | Lindstrom et al. |
| 3,549,533 | A | | 12/1970 | Tabor et al. |
| 4,204,481 | A | | 5/1980 | Malec |
| 4,634,452 | A | * | 1/1987 | Secor ..... 44/306 |
| 4,804,389 | A | | 2/1989 | Johnston et al. |
| 5,183,475 | A | | 2/1993 | Cardis et al. |
| 5,258,049 | A | * | 11/1993 | Liotta et al. ..... 44/324 |
| 5,559,358 | A | | 9/1996 | Burns et al. |
| 5,599,358 | A | * | 2/1997 | Giavazzi et al. ..... 44/388 |
| 5,882,364 | A | | 3/1999 | Dilworth et al. |
| 6,080,212 | A | * | 6/2000 | Beimesch et al. ..... 44/388 |

FOREIGN PATENT DOCUMENTS

| | | |
|---|---|---|
| EP | 303 862 A1 | 2/1989 |
| EP | 423 744 A1 | 4/1991 |
| EP | 517 569 A1 | 12/1992 |
| EP | 635 558 A1 | 1/1995 |
| EP | 0 363 302 B1 | 8/1995 |
| GB | 928353 | 2/1960 |
| GB | 1 061 161 | 3/1967 |
| GB | BG 2 158 457 A | 11/1985 |
| WO | WO 89/08395 | 9/1989 |
| WO | WO 94/17160 | 8/1994 |
| WO | WO 95/33805 | 12/1995 |
| WO | WO 96/18706 | 6/1996 |
| WO | WO97/04044 | 2/1997 |

OTHER PUBLICATIONS

Standard Specification for Tall Oil Fatty Acids, Mar. 10, 1969, Designation: D 1984-69 (pp. 270).
Tall Oil Products Division Pulp Chemicals Association, Tall Oil and Its Uses, L.G. Zachary, et al. 1965.
Transactions and Communications, Composition and fractionation of tall Oil. K.S. Ennor, et al. J. Oil Col. Chem. Assoc. 1967, vol. 50, (pp. 557-593).
Fatty Acid Data Book, Unichema International, 3rd edition, May 1992, (pp. 51).
Visit report, Jun. 10-14, 1990.
Results of the CRRA analysis dated Feb. 22, 2005 (no English translation).
Standard Test Methods for Fatty and Rosin Acids in Tall Oil Fractionation Products by Capillary Gas Chromatography, D 5974-00, date unknown.
Council directive 93/12/CEE dated Mar. 23, 1993.
Petroleum Refinery Engineering, W. L. Nelson, Fourth Edition, (pp. 48-51 and 67-58)l, date unknown.
Standard Classification of Diesel Fuel Oils, ASTM Designation: D 975- 68 (pp. 335-338), date unknown.

(Continued)

*Primary Examiner*—Cephia D. Toomer
(74) *Attorney, Agent, or Firm*—Oblon, Spivak, McClelland, Maier & Neustadt, P.C.

(57) ABSTRACT

The invention concerns a fuel for diesel engines, with a sulphur content of less than 500 ppm containing in a major proportion at least one average distillate from a straight-run distilling cup of crude oil, with temperature ranges between 150 and 400° C. and in a minor proportion a lubricating additive containing monocarboxylic and polycyclic acids. The said fuel is characterized in that it contains at least 20 ppm of the additive consisting of at least one monocarboxylic aliphatic hydrocarbon, saturated or unsaturated, of linear chain between 12 and 14 carbon atoms, and at least one polcyclic hydrocarbon compound, containing at least two cycles each formed of 5 to 6 atoms one of which at most is optionally a heteroatom such as nitrogen or oxygen and the other atoms are carbon atoms, these two cycles having further two carbon atoms in common, preferably vicinal, these said cycles being saturated or unsaturated, substituted or non-substituted by at least one single grouping selected among the carboxylic, amine carboxyl, ester and nitrile groupings, the fuel containing more than 60 ppm of additive when the said combination is tall oil.

50 Claims, No Drawings

OTHER PUBLICATIONS

Declaration, Mr. Donald McCulloch dated Nov. 9, 2005.
Total's letter dated Mar. 26, 1996.
Mr. McCulloch's memo dated Mar. 27, 1996.
Adibis' data sales, date unknown.
Agreement No. 96/000392 between Adibis and Total Raffinage Distribution, May 30, 1996 (no English translation).
Agreement No. 207/DFM/bm between Adibis and Total Raffinage Distribution, May 15, 1996.
Dictionary of Organic Compounds, Fifth Edition, vol. 5, (pp. 5087 and 5001), date unknown.
Kirk-Othmer, Encyclopedia of Chemical Technology, Third Edition, vol. 16, (pp. 949), date unknown.
Memorandum dated Jul. 25, 1996 plus complementary instruction dated Aug. 14, 1996 (no English translation).
Minutes of Total's meeting dated Aug. 5, 1996 (no English translation).
Minutes of Total's meeting dated Aug. 14, 1996.
Affidavit of Dr. M. Jee, In the Matter of the European Patent Convention and the opposition proceedings relating to European Patent No. 0915 944 B1, date unknown.
Kirk-Othmer, Encyclopedia of Chemical Technology, Fourth Edition, vol. 23, 1997, (pp. 616-622).
Declaration Under 37 CFR 1.132, Dr. Germanaud, Dec. 16, 2002.
Aviation Fuel Quality Requirement for Jointly Operated Systems, Issue 19, Sep. 2002 (pp. 1-2).
Product specification sheet ADX 4101B, Apr. 25, 1996.
Product specification sheet ADX 0787 A, Nov. 10, 1994.
Declaration, Dr. Jeffry G. Dietz, Jul. 19, 2004.
Declaration, Dr. David Aaserud, Jul. 19, 2004.
Letter of Idemitsu Kosan Co. Ltd., Invalidation Appeal No. 2002-35003, Jan. 31, 2003 with Minutes of the meeting dated Jun. 10, 1996 (Introduction of ADX410B).
Test report and validation, Aug. 29, 1996.
Edenor SB 05, date unknown.
Edenor PK 1805, date unknown.
Riegel's Handbook of Industrial Chemistry, Ninth Edition, James A. Kent, (pp. 273-279), date unknown.
Refined safflower oil (Interchimie)(no English translation), date unknown.
Letter of Idemitsu Kosan Co., Ltd, Invalidation Appeal No. 2002-35003, Jan. 31, 2003, with Minutes of meeting dated Feb. 5, 1996 (Introduction of ADX 4101R, Supply of the sample) with English translation.
Minutes of meeting dated Jun. 10, 1996 with English translation.
Results of the HFRR tests dated Mar. 11, 1996.

* cited by examiner

FUEL WITH LOW SULPHUR CONTENT FOR DIESEL ENGINES

This application is a Continuation of application Ser. No. 09/147,604 Filed on Mar. 17, 1999 now U.S. Pat. No. 6,592,639, allowed which is the National Stage of International Application No. PCT/FR97/01417, filed Jul. 29, 1997.

BACKGROUND OF THE INVENTION

Field of the Invention

The present invention relates to a fuel containing a lubricity additive for improving the lubricating properties of fuels, regardless of whether diesel fuel or jet fuel is involved, and more particularly of diesel fuels with a low sulphur content.

It is well known that diesel fuels and jet fuels must be capable of lubrication, for the protection of pumps, injection systems and of all the moving parts with which these products come into contact in an internal combustion engine. With the intention of employing products which are increasingly pure and nonpolluting, especially devoid of sulphur, the refining industry has been led increasingly to improve its treatment processes for the removal of sulphur compounds. However, it was noticed that, when losing the sulphur compounds, the aromatic and polar compounds, often associated, were also being lost, and this resulted in a loss of the lubricating power of these fuels. Thus, beyond certain contents, the elimination of sulphur compounds from the composition of these products very substantially promotes the phenomena of wear and of failure of moving components where pumps and injection systems are concerned. As in many countries the regulations have imposed a limitation on the acceptable upper content of sulphur compounds in fuels to 0.05% by weight, in order to lower the emissions of polluting combustion gases from cars, lorries and buses, especially in urban built-up areas, these lubricating compounds must be replaced with other compounds which are nonpolluting with regard to the environment but exhibit a sufficient lubricating power to avoid the risks of wear.

A number of types of additives have already been proposed in order to solve this problem. Antiwear additives have thus been added to diesel fuels, some of these being known in the field of lubricants, of the type of fatty acid esters and of unsaturated fatty acid dimers, aliphatic amines, esters of fatty acids and of diethanolamine and long-chain aliphatic monocarboxylic acids, as described in U.S. Pat. Nos. 2,252,889, 4,185,594, 4,204,481, 4,208,190 and 4,428,182. Most of these additives exhibit a sufficient lubricating power, but in concentrations which are much too high, and this is economically highly disadvantageous for purchase. Moreover, additives containing acid dimers, like those containing acid trimers, cannot be employed in fuels fed to vehicles in which the fuel may be in contact with the lubricating oil, because these acids form, by chemical reaction, deposits which are sometimes insoluble in the oil but, above all, incompatible with the detergents usually employed.

U.S. Pat. No. 4,609,376 recommends the use of anti-wear additives obtained from esters of mono- and poly-carboxylic acids and polyhydroxylated alcohols in fuels containing alcohols in their composition.

U.S. Pat. No. 2,686,713 recommends the introduction of tall oil up to 60 ppm in diesel fuels in order to prevent rust formation on metal surfaces in contact with these fuels.

Another chosen route is to introduce vegetable oil esters or vegetable oils themselves into these fuels, to improve their lubricating power or their lubricity. These include esters derived from rapeseed, linseed, soya and sunflower oils or the oils themselves (see patents EP 635,558 and EP 605,857). One of the major disadvantages of these esters is their low lubricating power at a concentration lower than 0.5% by weight in the fuels.

To improve the lubricating power of diesel fuels, patent application WO 95/33805 recommends the introduction of a cold-resistance additive consisting of nitrogenous additives containing one or more >N—$R^{13}$ groups in which $R^{13}$ contains from 12 to 24 carbon atoms, is linear, slightly branched or alicyclic and aromatic, it being possible for the nitrogenous group to be linked via CO or $CO_2$ and to form amine carboxylates or amides.

The present invention aims to solve the problems encountered with the additives proposed by the prior art, that is to say to improve the lubricating power of the desulphurized and dearomatized fuels, while they remain compatible with the other additives, especially detergents, and the lubricating oils, especially in not forming deposits and in reducing the cost, especially owing to a lower additive content, markedly lower than 0.5%.

The subject-matter of the present invention is a diesel engine fuel with a sulphur content lower than 500 ppm, including a major portion of at least one middle distillate originating from a direct distillation cut of crude oil, at temperatures of between 150 and 400° C. and a minor portion of a lubricity additive containing mono-carboxylic and polycyclic acids, the said fuel being characterized in that it contains at least 20 ppm of the additive consisting of a combination of at least one saturated or unsaturated, mono-carboxylic aliphatic hydrocarbon with a linear chain of between 12 and 24 carbon atoms, and of at least one polycyclic hydrocarbon compound containing at least two rings, each formed by 5 to 6 atoms of which at most one is optionally a heteroatom such as nitrogen or oxygen and the others are carbon atoms, these two rings additionally having two, preferably vicinal, carbon atoms in common, these said rings being saturated or unsaturated, unsubstituted or substituted by at least one single group chosen from the group made up of carboxylic, amine carboxylate, ester and nitrile groups, the fuel containing more than 60 ppm of additive when the said combination is tall oil.

It has been noticed that the lubricating power introduced by the lubricity additive containing such a combination is well superior to that foreseeable on adding the lubricating powers of each of its components taken separately. This unforeseeable result expresses the synergistic effect of the various components of the said composition with regard to lubrication.

According to a first embodiment of the fuel according to the invention the polycyclic hydrocarbon compound of the said combination is a hydrocarbon compound of formula (I) below:

(I)

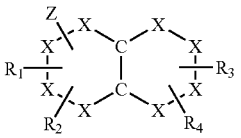

with X denoting the atoms of each ring corresponding to 4 carbons, or 3 carbons and a heteroatom such as nitrogen or oxygen, with $R_1$, $R_2$, $R_3$ and $R_4$, which are identical or different, denoting either a hydrogen atom or hydrocarbon groups, each connected to at least one atom of one of the two rings, these hydrocarbon groups being chosen from alkyl groups consisting of 1 to 5 carbon atom, aryl groups, hydrocarbon rings of 5 to 6 atoms, optionally containing a heteroatom such as oxygen or nitrogen, each ring being formed by direct connection of two groups $R_i$ chosen from $R_1$, $R_2$, $R_3$ and $R_4$, optionally via a heteroatom, the said ring being saturated or unsaturated, unsubstituted or substituted by an optionally olefinic, aliphatic radical containing from 1 to 4 carbon atoms, and Z is chosen from the group consisting of carboxylic groups, amine carboxylates, esters and nitrites.

In a particular version of this first embodiment, the compound of formula (I) is chosen from the group consisting of the natural resin-based acids obtained from residues of distillation of natural oils extracted from resinous trees, especially resinous conifers, and the amine carboxylates, esters and nitrites of these acids.

Among the resin-based acids preference is given to abietic acid, dihydroabietic acid, tetrahydroabietic acid, dehydroabietic acid, neoabietic acid, pimaric acid, laevopimaric acid and parastrinic acid and their derivatives.

In a second embodiment of the invention, the polycyclic hydrocarbon compound of the said combination is a hydrocarbon compound of formula (II) below:

(II)

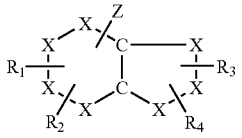

in which at most one X of each ring is a heteroatom such as nitrogen or oxygen, the other Xs being carbon atoms, in which $R_1$, $R_2$, $R_3$ and $R_4$, which are identical or different, are either a hydrogen atom or hydrocarbon groups, each connected to at least one atom of one of the two rings, these hydrocarbon groups being chosen from alkyl groups containing from 1 to 5 atoms, aryl groups, hydrocarbon rings of 5 to 6 atoms, optionally containing a heteroatom such as oxygen or nitrogen, each ring being formed by direct connection of two groups $R_i$ chosen from $R_1$, $R_2$, R, and $R_4$, optionally via a heteroatom, the said ring being saturated or unsaturated, unsubstituted or substituted by an optionally olefinic aliphatic radical containing from 1 to 4 carbon atoms, and Z, connected to at least one atom of at least one of the two rings, is chosen from the group consisting of carboxylic groups, amine carboxylates, esters and nitrites.

According to the invention the monocarboxylic aliphatic hydrocarbon is in the form of acid, of amine carboxylate and of esters.

In a more advanced version of the invention, the combination includes from 1 to 50% by weight of at least one compound corresponding to at least one of the formulae (I) and (II) and from 50 to 99% by weight of at least one saturated or unsaturated, linear monocarboxylic acid containing from 12 to 24 carbon atoms, these products being present in the form of acid, of amine carboxylate or of esters.

Amine carboxylates are intended to mean compounds resulting from the reaction of these acids with primary, secondary and tertiary amines or polyamines containing from 1 to 8 carbon atoms per chain and primary, secondary or tertiary alkyleneamines and alkylenepolyamines containing from 2 to 8 carbon atoms. In a preferred version of the invention these amine salts are derived from amines chosen from the group consisting of 2-ethyl-hexylamine, N,N-dibutylamine, ethylenediamine, diethylenetriamine and tetraethylenepentamine.

Among the esters preference is given to esters of primary alkanols containing from 1 to 8 carbon atoms or else polyalcohols of the group consisting of ethylene glycol, propylene glycol, glycerol, trimethylolpropane, pentaerythritol, diethanolamine, triethanolamine and their derivatives.

In a preferred version of the invention the fuel contains from 50 to 1000 ppm of the lubricity additive.

According to the present invention at least one additive from the group of the additives usually added to such fuels may be added to the said fuel, such as detergent additives, additives which improve the cetane number, deemulsifying additives, anticorrosion additives, additives which improve resistance to cold and odour-modifying additives.

To clarify the advantages of the present invention in comparison with the prior art, examples are given below by way of illustration but without limiting the scope of the invention claimed.

EXAMPLE I

This example describes the choice of the additives as a function of their solubility in a low-sulphur diesel fuel.

Each test additive is diluted to 5% by weight in a diesel fuel (DF) containing 500 ppm of sulphur, at ambient temperature.

In Table I, below, the additives according to the invention are denoted by Y and the comparative examples by C. The additives Y consist partly of a mixture of a combination of fatty acids containing, by weight, 50 to 55% of oleic acid, 30 to 40% of linoleic acid, 3 to 5% of palmitic acid and 1 to 2% of linolenic acid, and partly of resin-based acids obtained by distillation of tall oil, a by-product of manufacture of wood pulp by the sulphate process. In the case of the comparative examples, $C_1$ corresponds to pure oleic acid, $C_2$ to rosin, which is a mixture of resin-based acids corresponding to the residue from distillation of pine resins, and $C_3$ is a mixture of acid dimers obtained by thermal and/or catalytic dimerization of unsaturated fatty acids.

TABLE I

| Additive | % Fatty acids | % Resin-based acids | Solubility in DF |
|---|---|---|---|
| $Y_1$ | 70 | 30 | Soluble |
| $Y_2$ | 85 | 15 | Soluble |
| $Y_3$ | 98 | 2 | Soluble |
| $C_1$ | 100 | 0 | Soluble |
| $C_2$ | Cloudy | 100 | very cloudy |
| $C_3$ | 0 | 0 | Soluble |

From this table it is found that, with the exception of the resin-based acids ($C_2$), all these compounds are very soluble in diesel fuel.

EXAMPLE II

This example examines the lubricating power of the additives described in Example I.

The lubricating power of these additives was measured in the conditions of the HFRR (High Frequency Reciprocating Rig) test as described in the SAE paper 932692 by J. W. Hadley of Liverpool University.

The test consists in applying to a steel ball in contact with a motionless metal plate a pressure corresponding to a weight of 200 g conjointly with an alternating movement of 1 mm at a frequency of 50 Hz. The moving ball is lubricated by the composition being tested. The temperature is maintained at 60° C. throughout the test period, that is to say 75 min. The lubricating power is expressed by the mean value of the diameters of the wear imprint of the ball on the plate. A small wear diameter (generally smaller than 400 μm) indicates a good lubricating power; conversely, a large wear diameter (greater than 400 μm) expresses a power which is proportionately more insufficient the larger the value of the wear diameter.

The lubricating power of the additives was measured on a diesel fuel identical with that of Example I, each test sample containing only 100 ppm of additive. The results are given in Table II below.

TABLE II

| Sample | Wear diameter (μm) |
|---|---|
| Diesel fuel alone (DF) | 510 |
| DF + $Y_1$ | 350 |
| DF + $Y_2$ | 385 |
| DF + $Y_3$ | 410 |
| DF + $C_1$ | 440 |
| DF + $C_2$ | 470 |
| DF + $C_3$ | 380 |

This table shows that the additives ($Y_1$ and $Y_2$) according to the invention have an identical or even better effect than the acid dimers ($C_3$). In addition, it is found that the mixture of fatty acids with resin-based acids has a lubricating power which is much better than those obtained with these same compounds taken separately, expressing a mutual synergism of these components.

EXAMPLE III

This example examines the compatibility of the additives described in Example I with the lubricants usually employed in diesel engines, according to the procedure described below.

70 ml of an engine oil of total basicity equal to 15 mg of KOH per gram are mixed with 700 ml of diesel fuel containing 500 ppm of sulphur, identical with that of Example I, to which 35 g of additive are added. Each mixture thus formed is placed in an oven at 50° C. and then a visual assessment is made of the presence or the absence of deposits, of a precipitate or of cloudiness resulting from an incompatibility between the so-called "lubricity" additives, of sufficient lubricating power, with an engine lubricant called KM2+ marketed by the Renault Diesel Oils Company.

The compatibility results are collated in Table III below.

TABLE III

| Additive | Compatibility with the lubricant |
|---|---|
| $Y_1$ | No deposit—clear solution |
| $Y_2$ | No deposit—clear solution |
| $Y_3$ | No deposit—very slight turbidity |
| $C_1$ | Very slight cloudiness after 48 hours |

TABLE III-continued

| Additive | Compatibility with the lubricant |
|---|---|
| $C_2$ | Presence of a few insolubles |
| $C_3$ | Formation of cloudiness as soon as DF containing additive is added |

The additives of the invention, $Y_1$ and $Y_2$, give neither any deposit nor cloudiness when the diesel fuel containing 100 ppm of additive is added to the oil.

EXAMPLE IV

This example aims to describe the lubricity additives suitable for being introduced into the fuels according to the invention.

These are, on the one hand, esters obtained by reacting alcohols with the additive $Y_1$ of Example I in an equimolar mixture, in maintaining this mixture at reflux between 130 and 150° C. at atmospheric pressure, and in then distilling the water/toluene azeotrope.

On the other hand, they are amine carboxylates obtained merely by mixing, at ambient temperature and at atmospheric pressure, $Y_1$ with an amine or polyamine according to the invention, thus permitting the neutralization of the carboxylic sites.

These additives are introduced into a diesel fuel such as that described in Example II, at a concentration of 100 ppm.

Table IV collates below the results of the wear test described in Example II, which are obtained with the diesel fuel doped in this way, to characterize their lubricating power.

TABLE IV

| Nature of the additive (Y1 + etc.) | Wear diameter (μm) |
|---|---|
| Triethanolamine | 365 |
| N,N-dimethylethanolamine | 375 |
| ethylene glycol | 385 |
| Glycerol | 360 |
| propylene glycol | 380 |
| 2-ethylhexanol | 385 |
| N,N-dimethyl-1,3-propylenediamine | 360 |
| 2-ethylhexylamine | 370 |
| N,N-dibutylamine | 375 |
| Ethylenediamine | 355 |

According to these results it is confirmed that the fuels doped with such additives according to the invention have a good lubricating power.

The invention claimed is:

1. A diesel engine fuel, comprising:

sulfur in a content lower than 500 ppm;

a major portion of at least one middle distillate originating from a direct distillation cut of crude oil at temperatures of between 150 and 400° C.; and at least one lubricity additive selected from the group consisting of (a) and (b):

(a) at least 20 ppm of an additive which comprises a combination of:

at least one saturated or unsaturated, monocarboxylic aliphatic hydrocarbon having a linear chain of between 12 and 24 carbon atoms, and at least one polycyclic hydrocarbon compound containing at least two rings, each formed by 5 to 6 atoms of which at most one is optionally a heteroatom and the others are carbon atoms, the rings additionally having two carbon atoms in common, the rings being saturated or unsaturated, unsubstituted or substituted by at least one carboxylic group;

(b) at least one of an amine carboxylate and ester derivatives of one or more of the acids of at least one saturated or unsaturated, monocarboxylic aliphatic hydrocarbon having a linear chain of between 12 and 24 carbon atoms, and at least one polycyclic hydrocarbon compound containing at least two rings, each formed by 5 to 6 atoms of which at most one is optionally a heteroatom and the others are carbon atoms, the rings additionally having two carbon atoms in common, the rings being saturated or unsaturated, unsubstituted or substituted by at least one carboxylic group or an amine carboxylate group or an ester group.

2. The fuel according to claim 1, in which the polycyclic hydrocarbon compound of (a) is a hydrocarbon compound having the following formula (I):

(I)

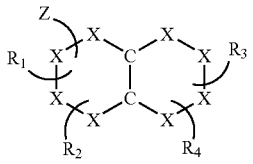

wherein X denotes the atoms of each ring corresponding to 4 carbons, or 3 carbons and a heteroatom, wherein $R_1$, $R_2$, $R_3$ and $R_4$ each independently are a hydrogen atom or hydrocarbon group, each connected to at least one atom of one of the two rings, wherein the hydrocarbon group is selected from the group consisting of alkyl groups with 1 to 5 carbon atoms, aryl groups, hydrocarbon rings with 5 to 6 atoms, optionally containing a heteroatom, each ring being formed by direct connection of two groups $R_i$ selected from the group consisting of $R_1$, $R_2$, $R_3$ and $R_4$, optionally via a heteroatom, said ring being saturated or unsaturated, unsubstituted or substituted by an optionally olefinic, aliphatic radical containing from 1 to 4 carbon atoms, and wherein Z is a carboxylic group.

3. The fuel according to claim 2, in which the compound of formula (I) is selected from the group consisting of the natural resin-based acids obtained from residues of distillation of natural oils extracted from resinous trees.

4. The fuel according to claim 2, in which the compound of formula (I) is selected from the group consisting of abietic acid, dihydroabietic acid, tetrahydroabietic acid, dehydroabietic acid, neoabietic acid, pimaric acid, laevopimaric acid, parastrinic acid, and derivatives thereof.

5. The fuel according to claim 1, in which the polycyclic hydrocarbon compound of (a) is a hydrocarbon compound of formula (II) below:

(II)

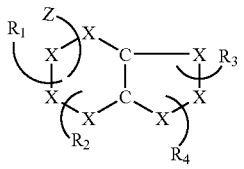

in which at most one X of each ring is a heteroatom, the other Xs being carbon atoms, in which $R_1$, $R_2$, $R_3$ and $R_4$, which are identical or different, are a hydrogen atom or hydrocarbon groups, each connected to at least one atom of one of the two rings, the hydrocarbon groups being selected from the group consisting of alkyl groups containing from 1 to 5 atoms, aryl groups, hydrocarbon rings of 5 to 6 atoms, optionally containing a heteroatom, each ring being formed by direct connection of two groups $R_i$ selected from the group consisting of $R_1$, $R_2$, $R_3$ and $R_4$, optionally via a heteroatom, said ring being saturated or unsaturated, unsubstituted or substituted by an optionally olefinic aliphatic radical containing from 1 to 4 carbon atoms, and Z, connected to at least one atom of at least one of the two rings, is a carboxylic group.

6. The fuel according to claim 1, in which (a) is in the form of acid, amine carboxylate, ester or a combination thereof, and (b) is in the form of an amine carboxylate, ester or a combination thereof.

7. The fuel according to claim 1, in which said combination in (a) includes from 1 to 50% by weight of at least one polycyclic hydrocarbon compound and from 50 to 99% by weight of at least one saturated or unsaturated, linear monocarboxylic aliphatic hydrocarbon containing from 12 to 24 carbon atoms.

8. The fuel according to claim 1, comprising an ester resulting from the reaction of an acid with an alcohol selected from the group consisting of primary alcohols containing from 1 to 8 carbon atoms and polyalcohols of ethylene glycol, propylene glycol, glycerol, trimethylolpropane, pentaerythritol, diethanolamine, triethanolamine and N,N-dimethylethanolamine.

9. The fuel according to claim 1, wherein (b) is an amine carboxylate resulting from the reaction of an acid with a primary, secondary or tertiary amine or polyamine containing from 1 to 8 carbon atoms per chain, primary, secondary or tertiary alkyleneamines and alkylenepolyamines containing from 2 to 8 carbon atoms.

10. The fuel according to claim 9, wherein (b) is one or more amine carboxylates, wherein the amines from which the amine carboxylates are derived are selected from the group consisting of 2-ethylhexylamine, N,N-dibutylamine, ethylenediamine, diethylene-triamine and tetraethylenepentamine.

11. The fuel according to claim 1, containing from 50 to 1000 ppm of said lubricity additive.

12. The fuel according to claim 1, in which said combination in (a) includes from 2 to 15% by weight of at least one polycyclic hydrocarbon compound and from 85 to 98% by weight of at least one saturated or unsaturated, linear monocarboxylic aliphatic hydrocarbon containing from 12 to 24 carbon atoms.

13. The fuel according to claim 1, in which said combination in (a) includes from 1 to 2% by weight of at least one polycyclic hydrocarbon compound and from 98 to 99% by weight of at least one saturated or unsaturated, linear monocarboxylic aliphatic hydrocarbon containing from 12 to 24 carbon atoms.

14. The fuel according to claim 1, wherein (a) comprises at least one monocarboxylic aliphatic hydrocarbon comprising at least one acid selected from the group consisting of oleic acid, linoleic acid, palmitic acid, linolenic acid and mixtures thereof.

15. The fuel according to claim 1, wherein (a) comprises at least one monocarboxylic aliphatic hydrocarbon comprising 50 to 55% by weight of oleic acid and 30 to 40% by weight of linoleic acid.

16. A diesel engine fuel having sulfur in a content lower than 500 ppm, comprising a major portion of at least one middle distillate originating from a direct distillation cut of crude oil at temperatures of between 150 and 400° C.; and at least one lubricity additive selected from the group consisting of (a) and (b):

(a) at least 20 ppm of an additive which consists of a combination of at least one saturated or unsaturated, monocarboxylic aliphatic hydrocarbon having a linear chain of between 12 and 24 carbon atoms, and of at least one polycyclic hydrocarbon compound selected from the group consisting of the natural resin-based acids obtained from residues of distillation of natural oils extracted from resinous trees, said combination including from 1 to 2% by weight of said at least one polycyclic hydrocarbon compound and from 98 to 99% by weight of said at least one monocarboxylic aliphatic hydrocarbon;

(b) at least one of an amine carboxylate and ester derivatives of one or more of the acids of at least one saturated or unsaturated, monocarboxylic aliphatic hydrocarbon having a linear chain of between 12 and 24 carbon atoms, and at least one of an amine carboxylate and an ester derivative of at least one polycyclic hydrocarbon compound selected from the group consisting of the natural resin-based acids obtained from residues of distillation of natural oils extracted from resinous trees, said combination including from 1 to 2% by weight of said at least one polycyclic hydrocarbon compound and from 98 to 99% by weight of said at least one monocarboxylic aliphatic hydrocarbon.

17. The fuel according to claim 16, in which the resin-based acids are selected from the group consisting of abietic acid, dihydroabietic acid, tetrahydroabietic acid, dehydroabietic acid, neoabietic acid, pimaric acid, laevopimaric acid, parastrinic acid and their derivatives.

18. The fuel according to claim 16, comprising an ester resulting from the reaction of an acid with an alcohol of the group consisting of the primary alcohols containing from 1 to 8 carbon atoms and polyalcohols of ethylene glycol, propylene glycol, glycerol, trimethylolpropane, pentaerythritol, diethanolamine, triethanolamine and N,N-dimethylethanolamine.

19. The fuel according to claim 16, containing from 50 to 1000 ppm of said lubricity additive.

20. The fuel according to claim 16, wherein (a) comprises at least one monocarboxylic aliphatic hydrocarbon comprising at least one acid selected from the group consisting of oleic acid, linoleic acid, palmitic acid, linolenic acid and mixtures thereof.

21. The fuel according to claim 16, wherein (a) comprises at least one monocarboxylic aliphatic hydrocarbon comprising 50 to 55% by weight of oleic acid and 30 to 40% by weight of linoleic acid.

22. A process for improving the lubricating properties of low-sulphur content diesel fuels, comprising adding to said diesel fuels at least one lubricity additive selected from the group consisting of (a) and (b):

(a) at least 20 ppm of an additive which comprises a combination of at least one saturated or unsaturated, monocarboxylic aliphatic hydrocarbon having a linear chain of between 12 and 24 carbon atoms, and of at least one polycyclic hydrocarbon compound containing at least two rings, each formed by 5 to 6 atoms of which at most one is optionally a heteroatom and the others are carbon atoms, these two rings additionally having two, carbon atoms in common, the rings being saturated or unsaturated, unsubstituted or substituted by at least one carboxylic group;

(b) at least one of an amine carboxylate and ester derivatives of one or more of the acids of at least one saturated or unsaturated, monocarboxylic aliphatic hydrocarbon having a linear chain of between 12 and 24 carbon atoms, and at least one polycyclic hydrocarbon compound containing at least two rings, each formed by 5 to 6 atoms of which at most one is optionally a heteroatom and the others are carbon atoms, these two rings additionally having two, carbon atoms in common, the rings being saturated or unsaturated, unsubstituted or substituted by at least one carboxylic group or an amine carboxylate group or an ester group.

23. The process according to claim 22, in which the polycyclic hydrocarbon compound of (a) is a hydrocarbon compound of formula (I) below;

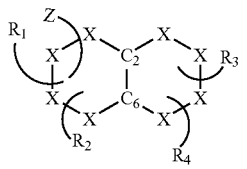

with X denoting the atoms of each ring corresponding to 4 carbons, or 3 carbons and a heteroatom, with $R_1$, $R_2$, $R_3$ and $R_4$, which are identical or different, being a hydrogen atom or hydrocarbon group, each connected to at least one atom of one of the two rings, the hydrocarbon group being selected from the group consisting of alkyl groups consisting of 1 to 5 carbon atoms, aryl groups, hydrocarbon rings of 5 to 6 atoms, optionally containing a heteroatom, each ring being formed by direct connection of two groups $R_1$ selected from the group consisting of $R_1$, $R_2$, $R_3$ and $R_4$, optionally via a heteroatom, the said ring being saturated or unsaturated, unsubstituted or substituted by an optionally olefinic, aliphatic radical containing from 1 to 4 carbon atoms, and Z is a carboxylic group.

24. The process according to claim 22, in which the compound of formula (I) is selected from the group consisting of the natural resin-based acids obtained from residues of distillation of natural oils extracted from resinous trees.

25. The process according to claim 22, comprising one or more the resin-based acids selected from the group consisting of abietic acid, dihydroabietic acid, tetrahydroabietic acid, dehydroabietic acid, neoabietic acid, pimaric acid, laevopimaric acid, parastrinic acid and their derivatives.

26. The process according to claim 22, in which the polycyclic hydrocarbon compound of (a) is a hydrocarbon compound of formula (II) below:

(II)

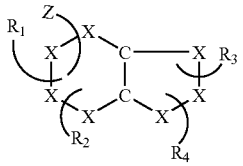

in which at most one X of each ring is a heteroatom, the other Xs being carbon atoms, in which $R_1$, $R_2$, $R_3$ and $R_4$, which are identical or different, are a hydrogen atom or a hydrocarbon group, each connected to at least one atom of one of the two rings, the hydrocarbon group being selected from the group consisting of alkyl groups containing from 1 to 5 atoms, aryl groups, hydrocarbon rings of 5 to 6 atoms, optionally containing a heteroatom, each ring being formed by direct connection of two groups $R_1$ selected from the group consisting of $R_1$, $R_2$, $R_3$ and $R_4$, optionally via a heteroatom, the said ring being saturated or unsaturated, unsubstituted or substituted by an optionally olefinic aliphatic radical containing from 1 to 4 carbon atoms, and Z, connected to at least one atom of at least one of the two rings, is a carboxylic group.

27. The process according to claim 22, in which said combination in (a) includes from 1 to 50% by weight of at least one polycyclic hydrocarbon compound and from 50 to 99% by weight of at least one saturated or unsaturated, linear monocarboxylic aliphatic hydrocarbon containing from 12 to 24 carbon atoms.

28. The process according to claim 22, comprising one or more esters resulting from the reaction of one or more acids with one or more alcohols of the group consisting of the primary alcohols containing from 1 to 8 carbon atoms and polyalcohols of ethylene glycol, propylene glycol, glycerol, trimethylolpropane, pentaerythritol, diethanolamine, triethanolamine and N,N-dimethylethanolamine.

29. The process according to claim 22, comprising an amine carboxylate resulting from the reaction of an acid with a primary, secondary or tertiary amine or polyamine containing from 1 to 8 carbon atoms per chain, primary, secondary or tertiary alkyleneamines and alkylenepolyamines containing from 2 to 8 carbon atoms.

30. The process according to claim 22, comprising one or more amine carboxylates derived from one or more amines selected from the group consisting of 2-ethylhexylamine, N,N-dibutylamine, ethylenediamine, diethylene-tri amine and tetraethylenepentamine.

31. The process according to claim 22, comprising adding from 50 to 1000 ppm of said lubricity additive.

32. The process according to claim 22, in which said combination in (a) includes from 2 to 15% by weight of at least one polycyclic hydrocarbon compound and from 85 to 98% by weight of at least one saturated or unsaturated, linear monocarboxylic aliphatic hydrocarbon containing from 12 to 24 carbon atoms.

33. The process according to claim 22, in which said combination in (a) includes from 1 to 2% by weight of at least one polycyclic hydrocarbon compound and from 98 to 99% by weight of at least one saturated or unsaturated, linear monocarboxylic aliphatic hydrocarbon containing from 12 to 24 carbon atoms.

34. The process according to claim 22, wherein (a) comprises at least one monocarboxylic aliphatic hydrocarbon comprising at least one acid selected from the group consisting of oleic acid, linoleic acid, palmitic acid, linolenic acid and mixtures thereof.

35. The process according to claim 22, wherein (a) comprises one or more monocarboxylic aliphatic hydrocarbon comprising 50 to 55% by weight of oleic acid and 30 to 40% by weight of linoleic acid.

36. The process according to claim 22, wherein (a) comprises one or more monocarboxylic aliphatic hydrocarbon comprising from 3 to 5% by weight of saturated acid.

37. A process for improving the lubricating properties of low-sulphur content diesel fuel, comprising adding to said diesel fuel at least one lubricity additive selected from the group consisting of (a) and (b):

(a) at least 20 ppm of an additive which consists of a combination of at least one saturated or unsaturated, monocarboxylic aliphatic hydrocarbon having a linear chain of between 12 and 24 carbon atoms, and of at least one polycyclic hydrocarbon compound selected from the group consisting of the natural resin-based acids obtained from residues of distillation of natural oils extracted from resinous trees, said combination including from 1 to 2% by weight of said at least one polycyclic hydrocarbon compound and from 98 to 99% by weight of said at least one monocarboxylic aliphatic hydrocarbon;

(b) at least one of an amine carboxylate and ester derivatives of one or more of the acids of at least one saturated or unsaturated, monocarboxylic aliphatic hydrocarbon having a linear chain of between 12 and 24 carbon atoms, and at least one of an amine carboxylate and an ester derivative of at least one polycyclic hydrocarbon compound selected from the group consisting of the natural resin-based acids obtained from residues of distillation of natural oils extracted from resinous trees, said combination including from 1 to 2% by weight of said at least one polycyclic hydrocarbon compound and from 98 to 99% by weight of said at least one monocarboxylic aliphatic hydrocarbon.

38. The process according to claim 37, in which the resin-based acids are selected from the group consisting of abietic acid, dihydroabietic acid, tetrahydroabietic acid, dehydroabietic acid, neoabietic acid, pimaric acid, laevopimaric acid, parastrinic acid and their derivatives.

39. The process according to claim 37, comprising an ester resulting from the reaction an acid with an alcohol of the group consisting of the primary alcohols containing from 1 to 8 carbon atoms and polyalcohols of ethylene glycol, propylene glycol, glycerol, trimethylolpropane, pentaerythritol, diethanolamine, triethanolamine and N,N-dimethylethanolamine.

40. The process according to claim 37, containing from 50 to 1000 ppm of said lubricity additive.

41. The process according to claim 37, wherein (a) comprises one or more monocarboxylic aliphatic hydrocarbon comprising at least one acid selected from the group consisting of oleic acid, linoleic acid, palmitic acid, linolenic acid and mixtures thereof.

42. The process according to claim 37, wherein (a) comprises one or more monocarboxylic aliphatic hydrocarbon comprising 50 to 55% by weight of oleic acid and 30 to 40% by weight of linoleic acid.

43. The fuel according to claim 2, wherein the hydrocarbon compound of formula (I) comprises one of nitrogen or oxygen.

44. The fuel according to claim 5, wherein the hydrocarbon compound of formula (II) comprises one of nitrogen or oxygen.

45. The process according to claim 23, wherein the hydrocarbon compound of formula (I) comprises one of nitrogen or oxygen.

46. The process according to claim 26, wherein the hydrocarbon compound of formula (II) comprises one of nitrogen or oxygen.

47. The process according to claim 22, wherein the low-sulphur content diesel fuel has a sulphur content of not more than 500 ppm.

48. The process according to claim 37, wherein the low-sulphur content diesel fuel has a sulphur content of not more than 500 ppm.

49. The fuel according to claim 3, wherein the resinous trees are coniferous resinous trees.

50. The process according to claim 24, wherein the resinous trees are coniferous resinous trees.

* * * * *